US005190777A

United States Patent [19]

Anderson et al.

[11] Patent Number: 5,190,777

[45] Date of Patent: Mar. 2, 1993

[54] PACKAGE FOR MICROWAVING POPCORN

[75] Inventors: Gary D. Anderson; George B. Bourns, both of Asheboro, N.C.; Earl E. Hoyt, Franklin Lakes, N.J.; Howard P. Siegel, Yonkers, N.Y.

[73] Assignee: American Home Food Products, Inc., New York, N.Y.

[21] Appl. No.: 519,353

[22] Filed: May 31, 1988

Related U.S. Application Data

[63] Continuation of Ser. No. 888,300, Jul. 18, 1986, abandoned.

[51] Int. Cl.[5] ..... B65D 21/08; B65D 25/36; B65D 81/34

[52] U.S. Cl. ..... 426/107; 426/111; 426/113; 426/124; 219/10.55 E; 229/101; 229/125.35

[58] Field of Search ..... 426/107, 111, 113, 124, 426/234, 243, 241, 118; 219/10.55 E; 229/101, 125.35

[56] References Cited

U.S. PATENT DOCUMENTS

| | | | |
|---|---|---|---|
| 2,633,284 | 3/1953 | Moffett et al. | 426/118 |
| 2,673,805 | 3/1954 | Colman | 426/111 |
| 2,673,806 | 3/1954 | Colman | 426/111 |
| 2,815,883 | 12/1957 | Robins et al. | 426/111 |
| 3,054,680 | 9/1962 | Mennen | 426/111 |
| 3,102,233 | 11/1963 | Mennen . | |
| 3,140,034 | 7/1964 | Wyman et al. | 426/111 |
| 3,144,194 | 8/1964 | Cartright . | |
| 3,185,578 | 5/1965 | Scharre | 426/114 |
| 3,561,668 | 2/1971 | Bergstrom | 426/124 |
| 3,671,270 | 6/1972 | Jehn | 426/111 |
| 3,782,976 | 1/1974 | Maier et al. | 426/111 |
| 3,851,574 | 12/1974 | Katz et al. | 426/111 |
| 3,973,045 | 8/1976 | Brandberg et al. | 426/234 |
| 3,997,677 | 12/1976 | Hirsch et al. | 426/118 |
| 4,013,798 | 3/1977 | Goltsos | 426/107 |
| 4,036,423 | 7/1977 | Gordon | 426/111 |
| 4,038,425 | 7/1977 | Brandberg et al. | 426/107 |
| 4,141,487 | 2/1979 | Faust et al. | 426/111 |
| 4,156,806 | 5/1979 | Teich et al. | 426/107 |
| 4,190,757 | 2/1980 | Turpin et al. | 426/107 |
| 4,292,332 | 9/1981 | McNam | 426/118 |
| 4,419,373 | 12/1983 | Oppermann | 426/118 |
| 4,425,368 | 1/1984 | Watkins | 426/107 |
| 4,435,628 | 3/1984 | Bowen et al. | 426/243 |
| 4,450,180 | 5/1984 | Watkins . | |
| 4,477,705 | 10/1984 | Danley et al. | 426/234 |
| 4,496,816 | 1/1985 | McNamara | 426/234 |
| 4,553,010 | 11/1985 | Bohrer et al. | 426/107 |
| 4,571,337 | 2/1986 | Cage et al. . | |
| 4,586,649 | 5/1986 | Webinger | 426/111 |
| 4,592,914 | 6/1986 | Kuchenbecker | 426/107 |
| 4,640,838 | 2/1987 | Isakon et al. | 426/118 |

*Primary Examiner*—Steven Weinstein
*Attorney, Agent, or Firm*—Gary R. Molnar

[57] ABSTRACT

A shelf stable package for shipping and popping corn in a microwave oven comprising, a bowl formed of microwaveable plastic, transparent to microwave energy with a conical bottom, a charge comprising corn kernels and a shortening, which is solid at room temperature, said kernels having a moisture content of at least about 11.5 percent by weight, and a plastic swirl cover layer, said plastic swirl being in the form of a plurality of folds disposed in a spiral arrangement being transparent to microwave energy, and being expansible in response to internal steam pressure generated by popping of said corn kernels. A microwave transparent paperboard shell covers at least a portion of said bowl. A metallized barrier layer can overlay said plastic swirl bonnet cover layer and in turn a paperboard outer cover overlaying said metallized barrier layer. A microwave transparent paperboard shell can cover at least a portion of said bowl with a pop assist layer attached to said paperboard shell and underlying said plastic bowl.

6 Claims, 3 Drawing Sheets

PACKAGE FOR MICROWAVING POPCORN

This application is a continuation, of application Ser. No. 888,300, filed Jul. 18, 1986, now abandoned.

FIELD OF THE INVENTION

The present invention relates to a corn containing package suitable for making popcorn in a microwave oven.

BACKGROUND OF THE INVENTION

There is a body of art in which corn kernels are popped on a conventional gas or electric stove. One of such device is seen in U.S. Pat. No. 3,144,194 to Cartright. A container cover for a popcorn package is shown by U.S. Pat. No. 3,054,680 of Mennen. In the Mennen patent is seen an aluminum foil inner cover which is preferably wrinkled and may be of a construction as in Robins et al U.S. Pat. No. 2,815,883 which will accommodate extension by expansion of a gaseous contents of food such as popcorn and popping oil. While Robins et al discloses a spiral round covering for popcorn containers, the device is shown as being made by hand. Subsequent thereto Mennen in U.S. Pat. No. 3,102,233 discloses apparatus for shaping metal foil suitable for use as an inner cover for a pan or container for popping corn. FIGS. 9–11 of that patent respectively show a sectional view of a food container having a formed foil cover, a sectional view illustrating in expanded condition the food container cover and the plan view of the formed food container cover. However, containers of the type just described are not suitable for use in microwave ovens where foil is prohibited. Accordingly, other types of containers for packages have been devised for shipping corn and popping same in a microwave oven. Illustrative thereof are U.S. Pat. No. 4,450,180 to Watkins which describes a paper container lined with a "greaseproof" paper liner and containing a charge of popcorn and fat in a small tubular portion of the package. It is intended that the corn charge within the bag sits in the bottom of a microwave oven when used for popping corn. U.S. Pat. No. 4,571,337 to Cage et al shows a paper bag containing a inner layer such as polyester, or more specifically polyethylene terephthalate instead of the "grease proof" paper layer of Watkins. Bohrer et al in U.S. Pat. No. 4,553,010 takes a slightly different approach. In Bohrer et al a paperboard box having on the bottom a metallized layer of polyethylene terephthalate as an interactive material with microwave energy is used as a "pop assist" to increase the popability of the corn.

Each of these packages for popping popcorn has its own disadvantage. For instance, the Watkins package with its greaseproof liner still permits staining of the outside package from the included shortening or oil. The Cage et al package, when unfolding, tends to strike the top of small microwave ovens and tilt on the side thereby popping only a small portion of the corn kernels therein. Bohrer presents to the user a disadvantage of having to open the package, remove at least a packet of corn and cooking oil, and often separate packets, opening said packet(s) and returning the contents thereof to the original package prior to the reassembly thereof and insertion into the microwave oven. Although Teich et al, U.S. Pat. No. 4,156,806, discloses a bowl having a downwardly directed conical bottom and means concentrating micro energy upon said conical bottom, Teich et al does not teach a device suitable for shipping and thereafter heating corn in a microwave oven.

SUMMARY OF THE INVENTION

The present invention provides a combination of ingredients for making popcorn, a container therefore suitable for shipping and suitable for popping corn, while overcoming many of the problems of the above patents. Broadly, the invention provides a shelf stable package for shipping corn for popping in a microwave oven comprising, a bowl formed of microwaveable plastic, transparent to microwave energy with a reverse conical bottom, a charge comprising corn kernels and a shortening, which is solid at room temperature, said kernels having a moisture content of at least about 11.5 percent by weight, a plastic swirl bonnet cover layer, said plastic swirl bonnet cover layer being in the form of a plurality of folds disposed in a spiral arrangement, being transparent to microwave energy, and being expansible in response to internal steam pressure generated by popping of said corn kernels, a metallized barrier layer overlaying said plastic swirl bonnet cover layer, said barrier layer adhering directly to said bowl, without adhering to said plastic swirl bonnet cover layer. Preferably, a paperboard outer cover overlies and protects the metallized barrier layer. The paperboard outer cover is suitable for application of the graphics, preferably prior to, but also subsequent to, its application overlying said metallized barrier layer. When desired, the metallized barrier layer can have the graphics applied directly thereto thus obviating the necessity for the preferred paperboard outer cover. The paperboard outer cover can be adhered to the metallized barrier layer whereby both it and the metallized barrier layer are removed as a single layer prior to insertion of the package into a microwave oven. Alternatively the paperboard and barrier layers need not be adhered to each other. In this event they are removed separately. Thus, in the microwave oven one sees a shelf stable package for shipping and popping corn in a microwave oven comprising, a bowl formed of microwaveable plastic, transparent to microwave energy with a conical bottom, a charge comprising corn kernels and a shortening, which is solid at room temperature, said kernels having a moisture content of at least about 11.5 percent by weight, and a plastic swirl cover layer, said plastic swirl being in the form of a plurality of folds disposed in a spiral arrangement being transparent to microwave energy, and being expansible in response to internal steam pressure generated by popping of said corn kernels.

In a preferred embodiment, the microwaveable plastic bowl is at least partially covered by a microwave transparent paperboard shell. This shell should remain attached to the plastic bowl and can provide at least one of three features. The microwave transparent paperboard shell will remain cool to the touch, while the plastic bowl becomes hot during the popping of the corn by microwave energy. Thus, the shell provides a cool handle for the hot bowl. The paperboard shell can also carry a "pop assist" layer, (also known as a "microwave susceptor" layer) such as described in the Bohrer et al patent, which describes it as microwave lossy material, underlining said plastic bowl thereby directing heat to the bottom of said bowl to increase the heat to the popping corn from the microwave lossy material.

The paperboard shell also can provide additional surface for graphics.

DETAILED DESCRIPTION OF THE PREFERRED EMBODIMENT

Figure 1:
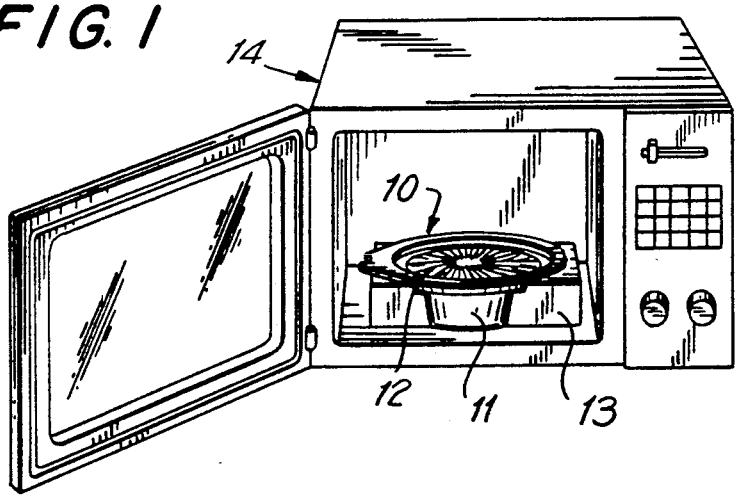
FIG. 1 is a perspective view of the corn containing microwave package in a microwave oven, prior to popping the corn.

The preferred embodiment will be described with reference to the drawing in which the same number is used for each item in all of the figures. The tens digit indicates the first figure in which the feature appears and the unit digit describes particular items within that figure.

Figure 2:
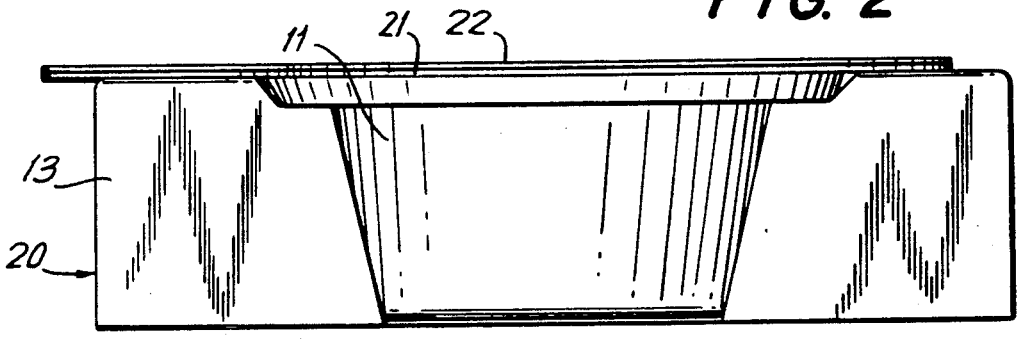
FIG. 2 is a side view of the entire package.
Figure 3:
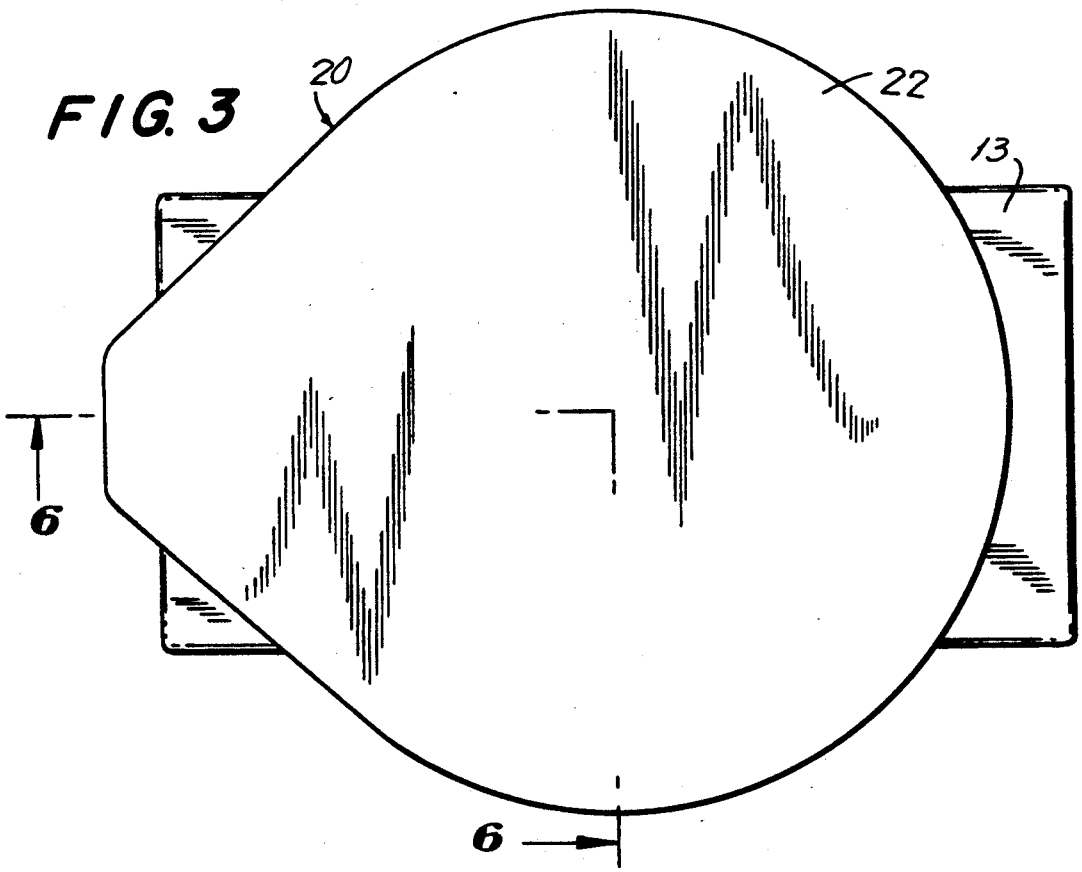
FIG. 3 is a plan view of the package.

A shelf stable package 10 for shipping and popping corn in a microwaveable oven, and constructed in accordance with the present invention is seen in FIGS. 1, 4, 5, 7 and 8. In FIGS. 2, 3 and 6 is the same bowl, now listed as 20, with appropriate cover layers thereon. These layers must be removed prior to insertion of the bowl into the microwave oven for popping of the corn contained therein.

Returning to FIG. 1, a suitable shelf stable package 10 for popping corn is disposed within a microwave oven 14. The package comprises a bowl formed of microwaveable plastic, i.e., polyethylene terephthalate, transparent to microwave energy and containing a charge of popcorn (not shown) therein. The bowl 11 has a plastic swirl cover layer 12 thereon and sits within a microwave transparent paperboard shell 13. As can be seen in FIGS. 2, 3 and 6 a paperboard cover layer, on which can be placed suitable graphics, surmounts the microwaveable transparent bowl. Also seen in FIG. 2 is an intermediate layer 21, preferably of metallized barrier material, between the bowl 11 and the paperboard outer cover 22. Other conventional barrier layers can be substituted for the metallized layer. Many of the construction details are best seen in FIG. 6, which shall be described further below.

Figure 4:
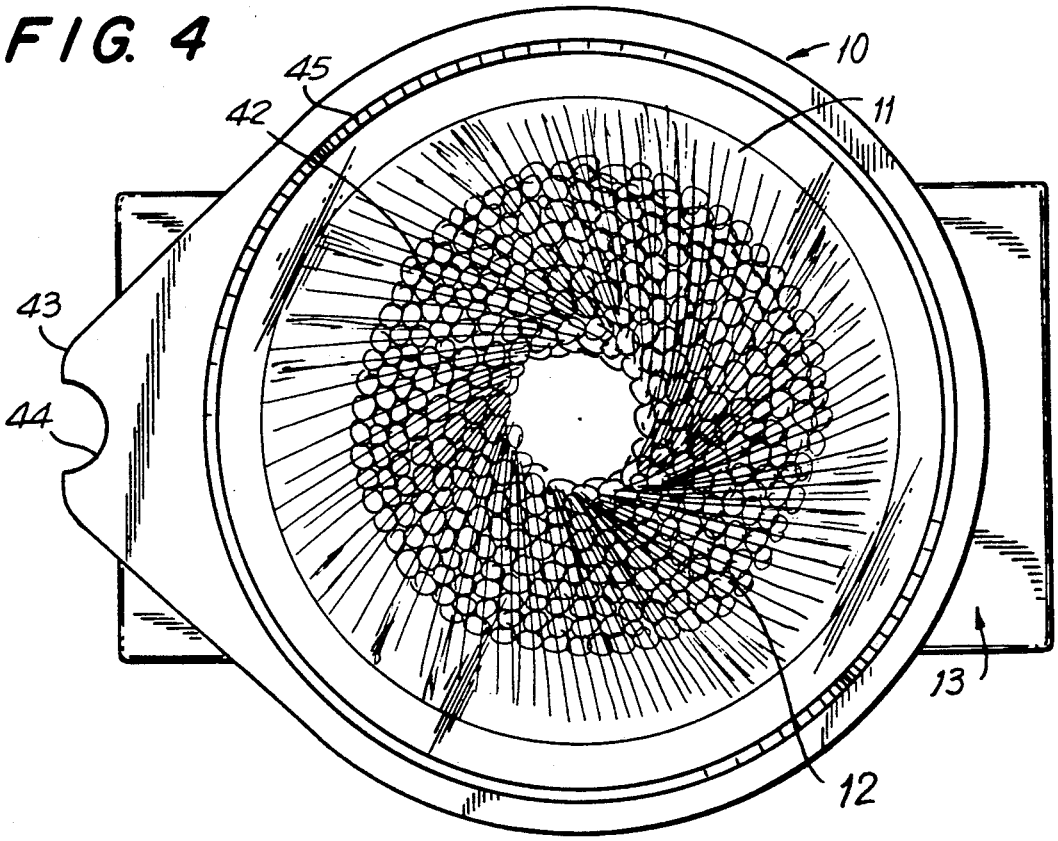
FIG. 4 is a plan view of the package with the metallized barrier layer removed.

Prior to placing the package into the oven for making popcorn, the lidding material is removed from FIG. 3 to leave exposed the package of FIG. 4. Seen in FIG. 4, is the upper face of a microwaveable transparent bowl 11 with an outer flange 41 and a plastic swirl cover 12. The latter is also described herein as a plastic swirl bonnet cover layer since the latter term is more descriptive when viewed in FIGS. 7 and 8. Within the plastic bowl 11 is a charge of corn kernels 42 for popping. The outer flange 41 has an end thereof 43 extending over the microwave transparent paperboard shell 13, which as seen in FIGS. 2 and 4 covers only a portion of the microwave transparent plastic bowl. The shell however, can also enclose the sides of the entire bowl. The overhanging end of the outer flange 43 has a notch therein 44, which although shown in semicircular form, can be of any shape whatsoever, for providing access for one to grip the metallized barrier layer 21 and/or paperboard outer layer 22 thereby easily removing these layers prior to placing the package 10 with its corn kernel charge 42 therein into a microwave oven 14 for popping corn.

Figure 5:
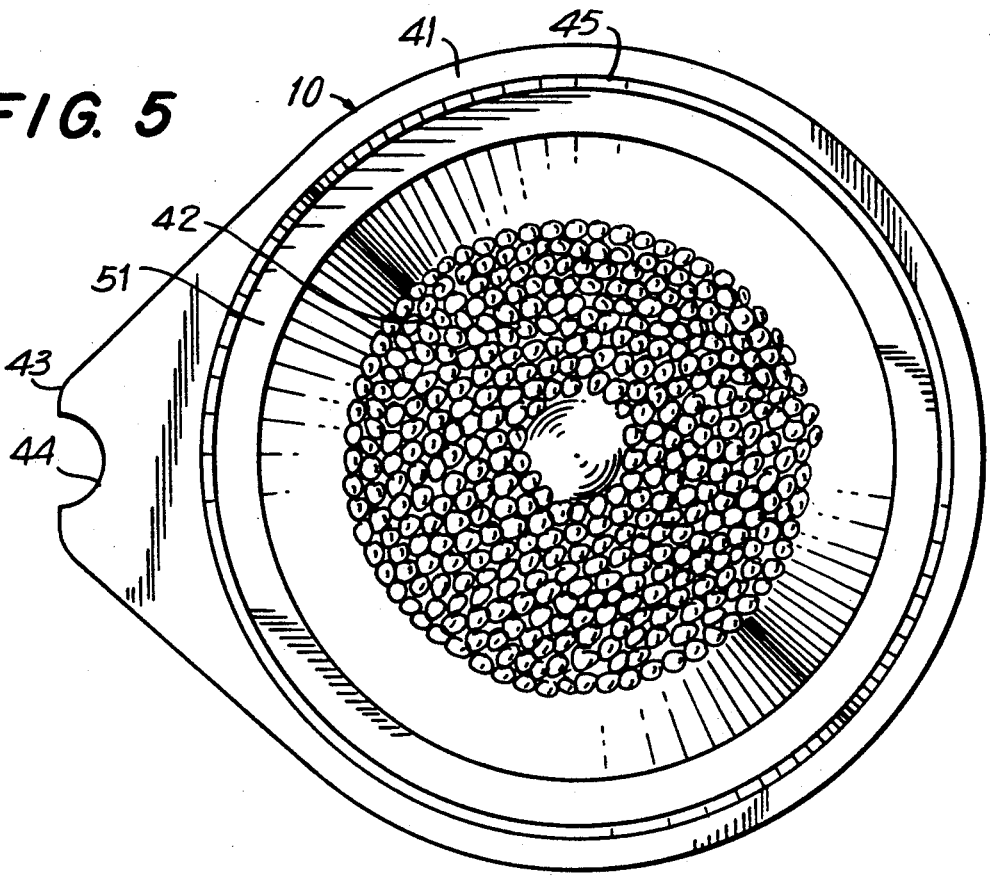
FIG. 5 is a plan view of the package of FIG. 4 with the plastic swirl bonnet cover layer also removed.
Figure 6:
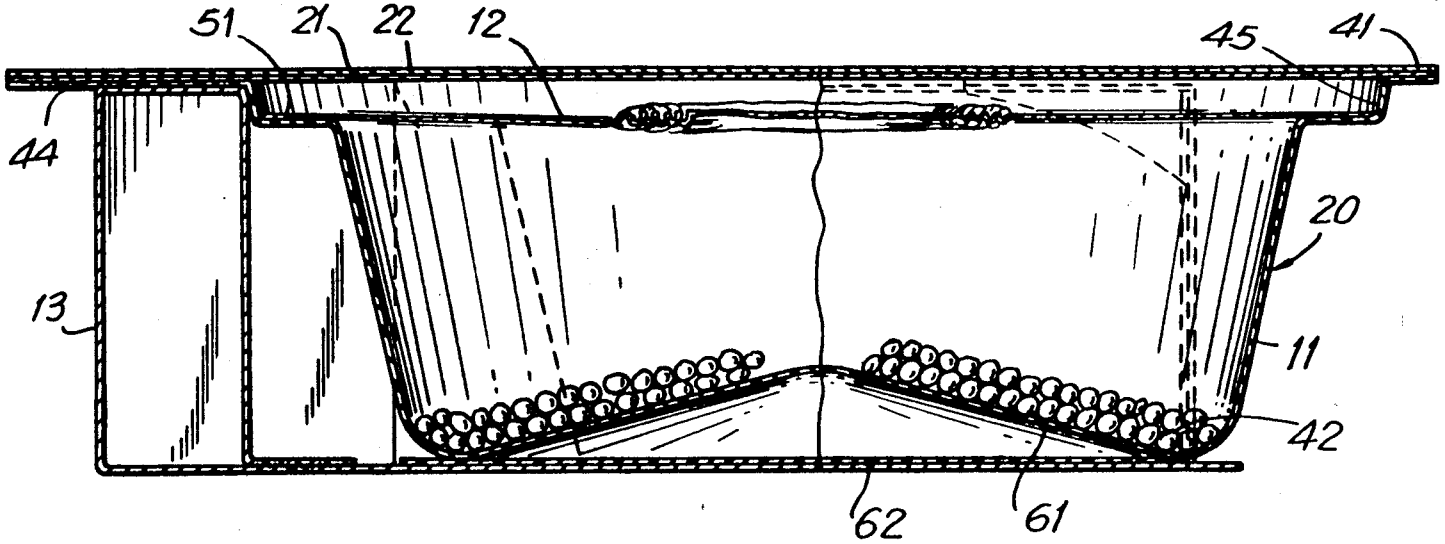
FIG. 6 is a cross sectional view along lines 6—6 of FIG. 3.

In FIG. 5, the plastic swirl bonnet cover layer 12 has been removed to more clearly show the charge of corn kernels 42. Also seen in this view is an inner flange 51 in stepped relationship with the outer flange 41, with riser 45 connecting outer flange 41 with inner flange 51. This stepped relationship is best seen in FIG. 6, which is a cutaway along lines 6—6 of FIG. 3. As seen therein, the plastic swirl cover layer 12 is attached to the inner flange 51 while the metallized cover layer is attached to the outer flange 41 with a paperboard cover layer 22, adhering to said metallized barrier layer 21. As seen in this view, the microwaveable plastic bowl has an upwardly directed conical bottom 61. The conical bottom 61 increases the likelihood that the corn kernels will concentrate around the circumference of the bowl with the apex having few or no kernels thereat. This concentration increases the mass to be microwaved and accordingly increases the efficiency of the microwave cooking process. To further concentrate the heat at the bottom of the plastic bowl 11 is pop assist patch 62 of microwaveable lossy material as described hereinabove.

Figure 7:
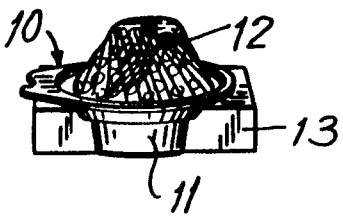

FIG. 7 shows a view of the package as the corn begins to pop within the bowl when heated by microwave energy with the plastic swirl bonnet cover layer beginning to open.

Figure 8:
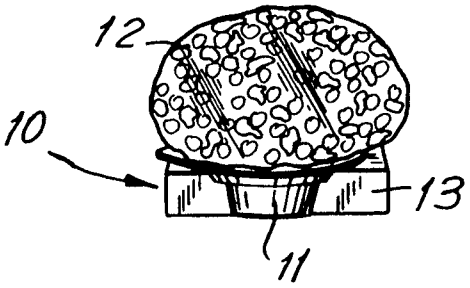
FIGS. 7 and 8 are perspective views of the plastic swirl cover layer opening as the corn is popping.

FIG. 8 shows the same package when fully popped with the plastic swirl bonnet cover layer fully opened.

The swirl material is a laminate of polyester (polyethylene terephthalate) with a melting point of around 500 degrees F. and a tack seal layer of polyethylene with a melting point of 250 degrees F. The swirl itself can be made by use of the technique of the Robins et al U.S. Pat. No. 2,815,883 or the Mennen apparatus in U.S. Pat. No. 3,102,233 applying a tack to seal the polyethylene layer to hold the swirl in place after formation from roll stock. The swirl is tack sealed at less than 325 degrees F. to the inner flange 51. A skip weld seal of about 525 degrees F. is formed as a broken concentric seal between the swirl material 12 and the inner frange 51. The tack seal holds the swirl in place while the stronger weld seal is applied. When the temperature within the bonnet exceeds 250 degrees F. as occurs during microwaving, the gases produced begin to inflate the swirl, which releases itself to form the bonnet. The skip weld seal holds the swirl in place while the food extends the swirl bonnet to its maximum volumn, while permitting at least some of the gases produced to automatically vent.

The corn kernels should have a moisture content of at least 11.5 percent by weight. A moisture content of 13 to 14 percent by weight is preferred with a moisture of about 13.5 percent being optimum. Corn kernels, preferably of uniform size, and a moisture content of at least 13.5 percent by weight, is placed into the bowl. A shortening, which is solid at room temperature, although liquid at temperatures in the order of 115 to 120 degrees F., is also placed into the bowl. Although a partially hydrogenated vegetable oil shortening, such as a combination of soybean and cotton seed oils is preferred, animal shortening or a mixture of animal shortening and vegetable may be used. Other ingredients may be added such as salt, natural and artificial colors and preservatives such as BHT, i.e. butylated hydroxytoluene may be added. The shortening solidifies as it cools and holds the corn kernels and other ingredients, if any, in place around the upwardly directed conical bottom. The use of the metallized barrier layer assists in preventing the corn kernels from losing moisture. The foil material is a conventional metallized foil lidding material such as available from Guardian Packaging Corporation, Batavia, Ill. and comprising combinations of metals, plastics and sealants.

We claim:

1. A shelf stable package for shipping and popping corn in a microwave oven comprising, a bowl formed of microwaveable plastic, transparent to microwave energy, and having sidewalls and an upwardly directed conical bottom that is conical substantially across the bottom between said sidewalls, a charge comprising corn kernels and a shortening, which is solid at room temperature, said kernels having a moisture content of at least about 11.5 percent by weight and being concentrated substantially around the circumference of the bowl on the conical bottom with the apex of the conical bottom having few or no kernels, and a plastic swirl cover layer secured to said bowl, said plastic swirl being in the form of a plurality of folds disposed in a spiral arrangement being transparent to microwave energy, and being expansible in response to internal steam pressure generated by popping of said corn kernels, a microwave transparent paperboard shell covering at least a portion of said bowl, said paperboard shell having a portion extending across and exteriorly covering said upwardly directed conical bottom, and a microwave susceptor layer attached to said portion of said paperboard shell and underlying and being spaced from said conical bottom of said bowl.

2. The package of claim 1, which further comprises a paperboard outer cover overlying said plastic swirl cover layer and adhering to said bowl.

3. The package of claim 1, which further comprises a metallized barrier layer overlaying said plastic swirl cover layer, said barrier layer adhering directly to said bowl without adhering to said plastic swirl cover layer.

4. The package of claim 3, which further comprises a paperboard outer cover overlaying said metallized barrier layer.

5. The package of claim 4, wherein said paperboard outer cover adheres to said metallized barrier layer.

6. The package of claim 5, wherein said plastic swirl cover layer permits at least some of the steam produced during popping to automatically vent.

* * * * *